US006841062B2

(12) United States Patent
Reynolds

(10) Patent No.: US 6,841,062 B2
(45) Date of Patent: Jan. 11, 2005

(54) CRUDE OIL DESULFURIZATION

(75) Inventor: Bruce E. Reynolds, Martinez, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 104 days.

(21) Appl. No.: 09/896,224

(22) Filed: Jun. 28, 2001

(65) Prior Publication Data

US 2003/0000867 A1 Jan. 2, 2003

(51) Int. Cl.[7] ..... C10G 69/02

(52) U.S. Cl. ..... 208/89; 208/92; 208/210; 208/212; 208/97; 208/59

(58) Field of Search ..... 208/89, 92, 210, 208/212, 97, 59

(56) References Cited

U.S. PATENT DOCUMENTS 3,174,925 A * 3/1965 Claussen et al. ..... 208/59
3,328,290 A * 6/1967 Hengstebeck ..... 208/89
3,617,528 A * 11/1971 Hilfman ..... 208/216 R
3,830,731 A 8/1974 Reed, Jr. et al. ..... 208/211
4,592,828 A * 6/1986 Chu et al. ..... 208/89
4,885,080 A 12/1989 Brown et al. ..... 208/218
4,994,171 A * 2/1991 Van Helden et al. ..... 208/67
5,009,768 A 4/1991 Galiasso et al. ..... 208/89
5,382,349 A 1/1995 Yoshita et al. ..... 208/49
5,403,469 A * 4/1995 Vauk et al. ..... 208/78
5,851,381 A 12/1998 Tanaka et al. ..... 208/210
6,224,747 B1 * 5/2001 Cash et al. ..... 208/58
6,432,297 B1 * 8/2002 Kalnes et al. ..... 208/58

* cited by examiner

*Primary Examiner*—Walter D. Griffin
(74) *Attorney, Agent, or Firm*—Penny L. Prater

(57) ABSTRACT

This invention relates to a crude oil desulfurization process which comprises hydrodesulfurizing a crude oil feed in a crude desulfurization unit. The desulfurized crude oil is then separated into a light gas oil fraction, a vacuum gas oil fraction and a vacuum residuum fraction. The vacuum gas oil is hydrocracked to form at least one low sulfur fuel product. The light gas oil fraction is hydrotreated. The vacuum gas oil may be hydrocracked in one or more stages. Hydrocracking in the second stage, if present, will convert of at least 20% of the first zone effluent, to create a low sulfur light gas oil fraction. The light gas oil fraction may then be hydrotreated.

13 Claims, 2 Drawing Sheets

CRUDE OIL DESULFURIZATION

FIELD OF THE INVENTION

The present invention is directed to a method for hydrodesulfurizing crude oil.

BACKGROUND OF THE INVENTION

Crude oil is conventionally processed by distillation followed by various cracking, solvent refining and hydroconversion processes to produce a desired slate of fuels, lubricating oil products, chemicals, chemical feedstocks and the like. An example conventional process includes distillation of a crude oil in an atmospheric distillation column to form a gas oil, naphtha, a gaseous product, and a atmospheric residuum. Generally, the atmospheric residuum is further fractionated in a vacuum distillation column to produce a vacuum gas oil and a vacuum residuum. The vacuum gas oil is usually cracked to more valuable light transportation fuel products by fluid catalytic cracking or hydrocracking. The vacuum residuum may be further treated to recover a higher amount of useful products. Such upgrading methods may include one or more of, for example, residuum hydrotreating, residuum fluid catalytic cracking, coking, and solvent deasphalting. Streams recovered from crude distillation at the boiling point of fuels have characteristically been used directly as fuels.

U.S. Pat. No. 4,885,080 teaches preparing a synthetic crude oil by fractionating a heavy crude oil, hydrodesulfurizing the distillate cut, hydrodemetallizing the residuum and combining the hydrotreated cuts with a third liquid fraction to form the synthetic crude oil. U.S. Pat. No. 3,830,731 teaches distilling a heavy hydrocarbon feedstock into a vacuum gas oil and a vacuum residuum fraction, and hydrodesulfurizing each fraction. However, increasingly tighter regulations on contaminant in fuels, particularly sulfur and aromatics, have forced many refiners to hydrorefine most and often all, of the fuel products. To meet the more stringent requirements for low sulfur diesel, refiners have added naphtha hydrotreaters for removing sulfur and nitrogen compounds from at least some of the refinery streams which go to make up the gasoline pool. In response to the more stringent requirements for clean diesel fuels, refiners have added diesel hydrotreaters for making the low sulfur, low aromatics diesel which are now preferred, and often required. More refiners are building hydrocrackers due to their ability to produce high quality low sulfur fuels. The light gaseous products processed in a refinery are generally treated to remove $H_2S$ and others sulfur containing components prior to use of the gaseous products for energy, as petrochemical feedstocks, as reforming feedstocks for making synthesis gas, or as building blocks for turning the gaseous products into higher molecular weight products.

Thus, in response to these tightening regulations, refiners have constructed separate hydroprocessing units to upgrade each of the fuel streams produced in the refinery. The net effect is a large number of similar processing units, each handling a separate stream, requiring additional tankage and operators. Specific streams are alternatively heated for reaction or fractionation, and then cooled for separation and storage. Multiple reaction systems requires multiple hydrogen supply, pressurization and distribution systems. It is desirable to have a process for hydroprocessing the entire crude oil into useful low aromatic, low sulfur products while significantly reducing the number of refinery processing steps and processing equipment required to convert the crude to useful products. Such a process is the subject of the present invention.

In U.S. Pat. No. 5,009,768, a complete crude or the atmospheric and vacuum residues thereof mixed with vacuum gas oils is demetallized and the demetallized product hydrotreated for hydrodenitrogenation and hydroconversion. In U.S. Pat. No. 5,382,349, a heavy hydrocarbon oil is hydrotreated, the hydrotreated oil distilled and a vacuum residue thermally hydrocracked in a slurry bed. U.S. Pat. No. 5,851,381 provides a method of refining crude oil by distillation and desulfurization. In the method, a naphtha fraction is separated from crude oil by distillation, with the remaining residual fraction after the naphtha fraction has been removed from the crude oil being hydrodesulfurized and the hydrodesulfurized fraction separated into further fractions, first in a high pressure separator and then by atmospheric distillation. A residue is further upgraded in a residue fluid catalytic cracking process.

SUMMARY OF THE INVENTION

In the present process, a crude oil feed is desulfurized and processed (hydrotreated and hydrocracked) to form low sulfur, low aromatic fuels in an integrated unit, with a single hydrogen supply and recovery loop, with minimal cooling of intermediate products, and without tank storage of intermediate products. The integrated unit comprises a series of catalytic reaction zones, each containing a single catalyst or a layered catalyst system selected for a particular application, whether it be desulfurization of a crude feed, hydrocracking a gas oil stream or hydrotreating a particular stream to reduce the aromatic and/or sulfur content of the stream to low levels. Flash separation of reaction products exiting a particular catalytic reaction zone is tailored to isolate hydrogen with minimal heat exchange beyond that required to prepare the reaction products for the next processing step.

In the present invention, a crude oil feed is passed directly to a crude desulfurization unit for desulfurization. The crude oil feed may be desalted and volatile materials removed prior to desulfurization, but a substantial portion of the crude oil feed is subjected to desulfurization in a desulfurization reaction zone. A number of reactions is expected to occur during the desulfurization process. Portions of the crude oil feed which contain metal-containing components will be at least partially demetallized during the desulfurization process. Likewise, nitrogen and oxygen are removed, along with sulfur, during the desulfurization process. While the amount of cracked products produced during desulfurization will be relatively small, some amount of larger molecules will be cracked to lower molecular weight products during the desulfurization process.

The desulfurized crude oil temperature is adjusted for fractionation, and a gas oil fraction isolated. The gas oil fraction is available for use directly as a fuel. Preferably, the gas oil fraction is further hydrotreated for additional sulfur, nitrogen and/or aromatic removal. Yields of desirable fuel products are increased in the present process when the desulfurized crude oil product is fractionated, preferably in a multi-stage fractionation zone having atmospheric and vacuum distillation columns. Products from multi-stage distillation include a light gas oil fraction, a vacuum gas oil fraction and a residual fraction. The light gas oil fraction, generally having a normal boiling of less than 700° F., may be used directly as a fuel, or further hydroconverted for improved fuel properties. The vacuum gas oil fraction is hydrocracked to increase the fuel yield in the present process and to further improve fuel properties. Single or multi-stage hydrocracking reactors may be employed. The hydrocracked products includes at least one low sulfur fuel product, which may be isolated from a step of distilling the hydrocracked products.

Accordingly, a process is provided for hydrodesulfurizing a crude oil feed in a crude desulfurization unit, separating the desulfurized crude oil and isolating a light gas oil fraction, a vacuum gas oil fraction and a residual fraction, hydrocracking the vacuum gas oil to form at least one low sulfur fuel product; and hydrotreating the light gas oil fraction. This entire integrated process may be conducted without using tank storage of intermediate products, such as a desulfurized crude oil, a light gas oil fraction, and a vacuum gas oil fraction. Further, with no required tank storage of intermediate products, the preferred process can be conducted without cooling of the intermediate products, thus reducing the operating cost of the process. In a further cost savings, the hydroconversion steps of the present process, including crude desulfurization, hydrocracking and hydrotreating, are suitably conducted using a single hydrogen supply loop, thus further reducing the capital and operating cost of the process.

The present invention provides an integrated refining system for processing a whole crude, or a substantial portion of a whole crude, into a full range of product materials at high selectivities and high yields of the desired products. The integrated process of the present invention further provides a series of reaction zones, containing catalysts of varying pore volume, for successively converting progressively lighter and cleaner products in the production of fuel products. The integrated process further provides an method for isolating, purifying and providing hydrogen to the various conversion reaction zones through the use of a single hydrogen isolation and pressurization unit. Among other factors, the present invention is based on an improved understanding of hydroconversion processes, permitting more efficient use of a combination of units for reaction, for product isolation, for hydrogen isolation and recycle, and for energy usage in the preparation of fuels from a crude feed. In the process, a wide range of fuel oil products can be safely prepared with a small number of reaction vessels and product recovery vessels, and with a minimum number of supporting vessels, for handling hydrogen and intermediate products, and employing a minimum number of operators. In effect, the present invention is based on the novel combination of crude desulfurization tailored to a wide boiling range feed, followed by distillation to form a few distillate streams, and bulk upgrading in an integrated hydrocracking/hydrotreating process to form a wide range of useful fuel and lubricating oil base stock products. The present process provides an efficient and less costly alternative to the conventional refinery practice of separating a crude oil feed into a number of distillate and residuum fractions, each of which are processed individually in similar but separate upgrading processes.

a) hydrodesulfurizing a crude oil feed in a crude desulfurization unit;

b) separating the desulfurized crude oil and recovering a light gas oil fraction, a vacuum gas oil fraction and a vacuum residuum fraction;

c) hydrocracking the vacuum gas oil to form at least one low sulfur fuel product; and d) hydrotreating the light gas oil fraction.

Figure 2:
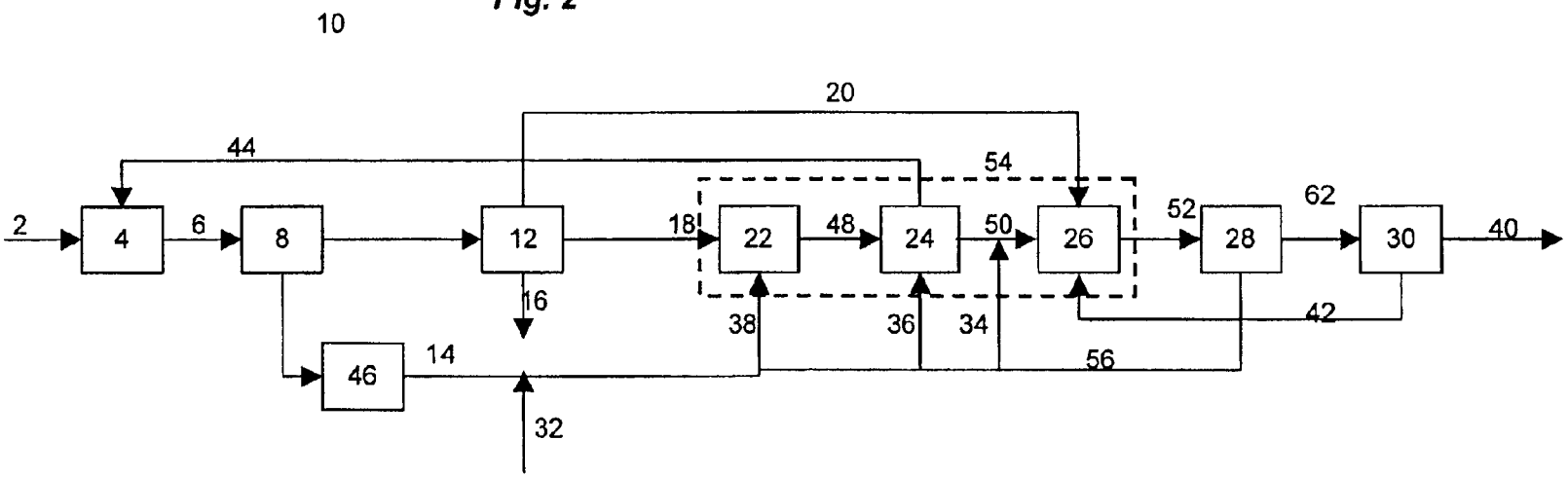

FIG. 2 discloses a crude oil desulfurization process which comprises the following steps:

a) hydrodesulfurizing a crude oil feed;

b) separating the desulfurized crude oil and recovering at least a light gas oil fraction, a vacuum gas oil fraction and a residual fraction;

c) hydrocracking the vacuum gas oil in a first hydrocracking reaction zone to reduce the sulfur content and the nitrogen content therefrom and to produce a low sulfur gas oil product;

d) hydrocracking the low sulfur gas oil product in a second hydrocracking reaction zone at a conversion of at least 20% to form at least one low sulfur fuel product; and e) hydrotreating the light gas oil fraction.

DETAILED DESCRIPTION OF THE PREFERRED EMBODIMENTS DEFINITIONS

For the purposes of this specification, the term "middle distillates" as used herein is to be taken as a reference to hydrocarbons or hydrocarbon mixtures having a boiling point or boiling point range substantially corresponding to that of the kerosene and diesel fractions obtained during the conventional atmospheric distillation of crude oil feed. The term "light gas oil" (LGO) as used herein is to be taken as a reference to hydrocarbons or hydrocarbon mixtures which are isolated as distillate streams obtained during the conventional atmospheric distillation of a refinery stream, a petroleum stream or a crude oil stream. The term "vacuum gas oil" (VGO) as used herein is to be taken as a reference to hydrocarbons or hydrocarbon mixtures which are isolated as distillate streams obtained during the conventional vacuum distillation of a refinery stream, a petroleum stream or a crude oil stream. The term "naphtha" as used herein is a reference to hydrocarbons or hydrocarbon mixtures having a boiling point or boiling point range substantially corresponding to that of the naphtha (sometimes referred to as the gasoline) fractions obtained during the conventional atmospheric distillation of crude oil feed. In such a distillation, the following fractions are isolated from the crude oil feed: one or more naphtha fractions boiling in the range of from 30 to 220° C., one or more kerosene fractions boiling in the range of from 120 to 300° C. and one or more diesel fractions boiling in the range of from 170 to 370° C. The boiling point ranges of the various product fractions isolated in any particular refinery will vary with such factors as the characteristics of the crude oil source, refinery local markets, product prices, etc. Reference is made to ASTM standards D-975 and D-3699-83 for further details on kerosene and diesel fuel properties. The term "hydrocarbon fuel" is to be taken as a reference to either one or a mixture of naphtha and middle distillates. Unless otherwise specified, all distillation temperatures listed herein refer to normal boiling point and normal boiling range temperatures. By "normal" is meant a boiling point or boiling range based on a distillation at one atmosphere pressure, such as that determined in a D1160 distillation.

The term "hydrotreating" as used herein refers to a catalyst process wherein a suitable hydrocarbon-based feed stream is contacted with a hydrogen-containing treat gas in the presence of suitable catalysts for removing heteroatoms, such as sulfur and nitrogen and for some hydrogenation of aromatics.

The term "desulfurization" as used herein refers to a catalyst process wherein a suitable hydrocarbon-based feed stream is contacted with a hydrogen-containing treat gas in the presence of suitable catalysts for removing heteroatoms such as sulfur atoms from the feed stream.

The term "hydrocracking" as used herein refers to a catalyst process wherein a suitable hydrocarbon-based feed stream is contacted with a hydrogen-containing treat gas in the presence of suitable catalysts for reducing the boiling point and the average molecular weight of the feed stream.

CRUDE DESULFURIZATION UNIT

The crude oil feed to the present process is generally a whole crude which has not been substantially separated into individual fractions. Removing volatile gases and light liquids (including $C_1$ to $C_4$ hydrocarbons) prior to introducing the crude oil feed to the crude desulfurization unit is generally preferred. The crude oil feed is also treated in a desalting unit prior to desulfurization. The full benefits of the practice of the invention are equally realized if a naphtha fraction is removed from the crude oil feed prior to treating in the crude desulfurization unit.

FIG. 1 REACTOR CONFIGURATION

Figure 1:
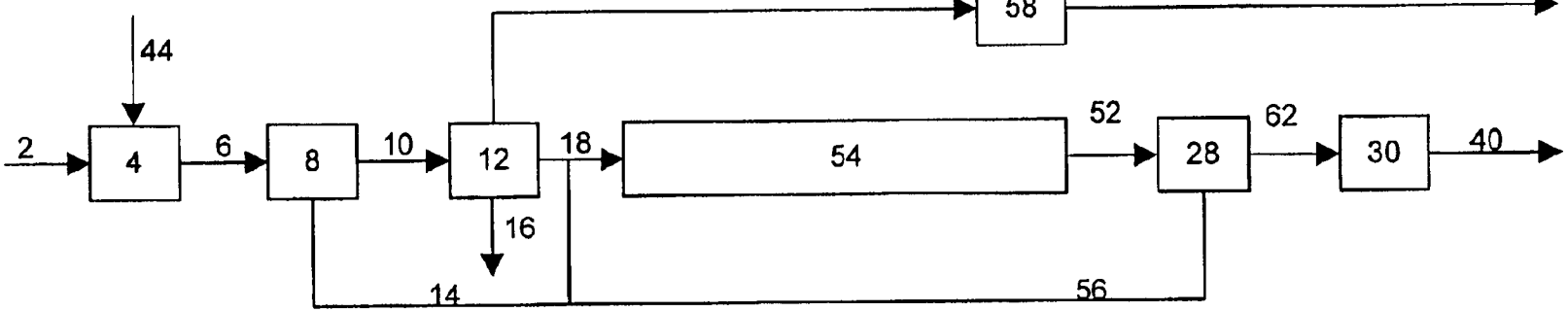
FIG. 1 discloses a crude oil desulfurization process which comprises the following steps.

Referring now to FIG. 1, a crude oil feed 02 is passed to a crude desulfurization unit 04 in combination with a hydrogen rich stream 44 for hydrodesulfurizing the crude oil feed. Crude desulfurization unit 04 comprises one or more reaction zones, each of which contains one or more catalyst beds. The crude desulfurization unit removes a substantial portion of the contaminants present in the crude oil feed, including metals, sulfur, nitrogen and Conradson carbon. Catalysts provided in crude desulfurization unit 04 for removing these contaminants may include a single catalyst or a layered catalyst system comprising multiple catalysts present in one or more reactors. When using a reaction train comprising more than one reactor in series operation, a major portion, if not all, of the liquid product from each reactor (except the last reactor vessel in the reaction train) is passed to a next reactor for additional processing. In the layered catalyst system, catalysts are preselected for their intended specific use, whether it be demetallation, or sulfur and nitrogen removal, or asphaltene and Conradson carbon removal, or mild conversion. Different catalyst layers may also be selected to facilitate the desulfurization of various boiling point fractions present in the crude oil feed, including naphtha fractions, middle distillate fractions, vacuum gas oil fractions and/or residuum fractions.

DESULFURIZATION UNIT CATALYST

Catalysts for use in the crude desulfurization unit 04 are generally composed of a hydrogenation component, selected from Group VIb (preferably molybdenum and/or tungsten, more preferably molybdenum) and Group VIII (preferably cobalt and/or nickel) of the Periodic Table, or a mixture thereof, all supported on an alumina support. Phosphorous (Group Va) oxide is optionally present as an active ingredient. A typical desulfurization catalyst contains from 3 to 35 wt % hydrogenation components, with an alumina binder.

The catalyst pellets range in size from 1/32 inch to 1/8 inch. A spherical, extruded, trilobate or quadrilobate shape is preferred. In general, the crude oil feed passing through the desulfurization unit contacts first a catalyst preselected for metals removal, though some sulfur, nitrogen and aromatic removal will also occur. Subsequent catalyst layers are preselected for sulfur and nitrogen removal, though they would also be expected to catalyze the removal of metals and/or cracking reactions.

Catalyst layer(s) preselected for demetallization comprise catalyst(s) having an average pore size ranging from 125 to 225 Å and a pore volume ranging from 0.5–1.1 $cm^3/g$. Catalyst layer(s) preselected for denitrification/desulfurization comprise catalyst(s) having an average pore size ranging from 100 to 190 Å with a pore volume of 0.5–1.1 $cm^3/g$. U.S. Pat. No. 4,90,243 describes a hydrotreating catalyst having a pore size of at least about 60 Å, and preferably from about 75 Å to about 120 Å. A demetallation catalyst useful for the present process is described, for example, in U.S. Pat. No. 4,976,848, the entire disclosure of which is incorporated herein by reference for all purposes. Likewise, catalysts useful for desulfurization of heavy streams are described, for example, in U.S. Pat. Nos. 5,215,955 and 5,177,047, the entire disclosures of which is incorporated herein by reference for all purposes. Catalysts useful for desulfurization of middle distillate, vacuum gas oil streams and naphtha streams are described, for example, in U.S. Pat. No. 4,990,243 the entire disclosures of which are incorporated herein by reference for all purposes.

Reaction Conditions

It is desirable that the crude desulfurization unit 04 be controlled to maintain the product sulfur at a specified maximum concentration. For example, when the product sulfur is maintained at less than 1 wt % based on feed, and preferably less than 0.75 wt % based on feed, reaction conditions in the crude desulfurization unit 04 include a reaction temperature between about 315° C. and 440° C. (600° F.–825° F.), pressures from 6.9 MPa to about 20.7 MPa (1000–3000 psi), and a feed rate (vol oil/vol cat hr) from 0.1 to about 20 $hr^{-1}$. Hydrogen circulation rate are general in the range from about 303 std liter $H_2$/kg oil to 758 std liters $H_2$/kg oil (2000–5000) standard cubic feet per barrel).

DESULFURIZED CRUDE OIL PROPERTIES

The crude oil desulfurization process removes greater than 25% w/w, preferably greater than 50% w/w of the sulfur present in the crude oil feed 02. The preferred desulfurized crude oil 06 typically has a sulfur content of less than 1 wt %, preferably less than 0.75 wt %, still more preferably less than 0.5 wt %.

DESULFURIZED CRUDE DISTILLATION

Unreacted hydrogen isolated from crude desulfurization unit 04 is separated from desulfurized crude oil 06 in one or more flash zones 08 (e.g. a desulfurization unit high pressure separator) and the resultant desulfurized liquid 10 is passed to crude fractionator 12 for fractionation to produce at least a light gas oil fraction 20, a vacuum gas oil fraction 18 and a residuum fraction 16. Crude fractionator 12 is a single or multiple column fractionation system, and preferably a two column or stage fractionator. One example two-stage fractionator comprises an atmospheric distillation column operated substantially at or slightly above atmospheric pressure, and a vacuum distillation column operated at sub-atmospheric pressure. Such distillation column systems are well known. In a preferred process of the invention, desulfurized liquid 10 is passed from flash separation zone(s) 08 directly to crude fractionator 12 without cooling desulfurized liquid 10 beyond that required for the distillation in crude fractionator 12. The temperature of stream 10 passing from 8 to 12 is preferably maintained at a temperature of at least 250° F., and preferably of at least 600° F. In the embodiment illustrated in FIG. 1, all of the desulfurized crude oil, absent light gases, are passed to crude fractionator 12 for fractionation.

HYDROCRACKING UNIT

The vacuum gas oil fraction 18 from the crude fractionator 12 is passed to the hydrocracking unit 54, preferably directly, without tankage and with minimal heat removal, for further processing to produce low sulfur and low aromatic hydrocarbon fuels. The hydrocracking unit 54 contains catalyst selected for further removal of sulfur and nitrogen compounds, for saturation and removal of aromatic compounds, and for cracking for molecular weight reduction. For the present invention, conversion is generally related to a reference temperature, such as, for example, the minimum boiling point temperature of the hydrocracker feedstock. The extent of conversion relates to the percentage of feed boiling above the reference temperature which is converted during hydrocracking into hydrocrackate boiling below the reference temperature. Where the reference temperature is selected to be, e.g. 370° C. (700° F.), overall conversion during hydrocracking in hydrocracking unit 54 is typically greater than 10%, and preferably greater than 20%.

2ND STAGE PRODUCT

Effluent from hydrocracking unit 54 is separated in one or more flash separation units 28 (e.g. hydrocracker separation unit) to isolate at least a hydrocracked liquid product 62, which is passed to product fractionator 30 for fractionation. In the preferred process, recycle $H_2$ stream 56 is separated from hydrocracked effluent 52 for recycle to various units in the integrated process, and the remaining liquid 62 is passed to a product fractionator 30 for isolating fuel product(s). The purity of recycle $H_2$ stream 56 will generally be maintained at greater than 75 mole % hydrogen. In order to maintain energy efficiency, hydrocracked liquid product 62 is passed to fractionator 30 without substantial cooling of 62. At least one fuel product, 40, is isolated from product fractionator 30.

NAPHTHA PRODUCT

Light gas oil 20 is isolated from crude fractionator 12. This stream may be blended into a gasoline pool without further processing if desired, particularly if the sulfur level of light gas oil 20 is below 300 ppm, and preferably below 100 ppm. Alternatively, light gas oil 20 is hydrotreated in hydrotreating reaction zone 58 to reduce sulfur levels to below 100 ppm, preferably below 50 ppm, and more preferably below 15 ppm. Stream 60 is isolated as desirably low sulfur naphtha.

FIG. 2 CRUDE OIL DESULFURIZATION

In the preferred embodiment illustrated in FIG. 2, crude oil feed 02 is passed to crude desulfurization unit 04 for removing contaminants, e.g. one or more of sulfur, nitrogen, asphaltenes, Conradson carbon, from the crude oil feed 02. As described above with respect to FIG. 1, desulfurized crude oil 06 is treated in one or more flash zones 08 to remove unreacted hydrogen and light hydrocarbon products 14. The desulfurized liquid 10 from the flash zone(s) 08 is then passed to a crude fractionator 12. In a preferred process of the invention, desulfurized liquid 10 is passed from flash separation zone(s) 08 directly to crude fractionator 12 without cooling desulfurized liquid 10 beyond that required for the distillation in crude fractionator 12. The temperature of stream 10 passing from 8 to 12 is preferably maintained at a temperature of at least 250° F., and preferably of at least 300° F. At least residuum fraction 16, vacuum gas oil 18, and light gas oil 20 are isolated from crude fractionator 12.

DESULFURIZED PRODUCT DISTILLATION

Fractionation zone 12 may be a single distillation column, or multiple distillation columns, each positioned in serial flow with respect to the other. In a preferred embodiment of the process, the desulfurized liquid 10 is fractionated in fractionation zone 12 which comprises at least one distillation column (not shown) which is operated substantially at or slightly above atmospheric pressure (i.e. an atmospheric distillation column) and at least one distillation column (not shown) which is operated at sub-atmospheric pressure (i.e. a vacuum distillation column). Such distillation columns are well known in the art. Desulfurized liquid 10 is passed to the atmospheric distillation column to produce at least naphtha stream 20 and an atmospheric residuum, which is further fractionated in the vacuum distillation column. A vacuum gas oil 18 is isolated as a distillate fraction from the vacuum distillation column, and vacuum residuum stream 16 is isolated as a bottoms fraction from the vacuum distillation column.

The vacuum gas oil 18 is passed directly to hydrocracker unit hydrocracking unit 54 for conversion to lower molecular weight products and for reduction in sulfur, nitrogen and/or aromatic content. As shown in the preferred embodiment illustrated in FIG. 2, the hydroconversion step involves at least two reaction vessels, first hydrocracker stage 22 and second hydrocracker stage 26. The hydrocracking process is especially useful in the production of middle distillate fractions boiling in the range of about 250°–700° F. (121°–371° C.) as determine by the appropriate ASTM test procedure. The hydrocracking process involves conversion of a petroleum feedstock by, for example, molecular weight reduction via cracking, hydrogenation of olefins and aromatics, and removal of nitrogen, sulfur and other heteroatoms. The process may be controlled to a certain cracking conversion or to a desired product sulfur level or nitrogen level or both. Conversion is generally related to a reference temperature, such as, for example, the minimum boiling point temperature of the hydrocracker feedstock. The extent of conversion relates to the percentage of feed boiling above the reference temperature which is converted during hydrocracking into hydrocrackate boiling below the reference temperature.

HYDROGEN RECOVERY

The hydrogen stream 14 isolated from flash separation zone 08 may be further purified in, for example, an amine scrubber 46 to remove some or all of the $H_2S$ and $NH_3$ gases. Following compression, the purified hydrogen is passed to the first hydrocracker stage 22 and the second hydrocracker stage 26.

1ST STAGE

Reaction in first hydrocracker stage 22 is maintained at conditions sufficient to further remove nitrogen and sulfur contaminants from the vacuum gas oil feed 18 and for reducing the aromatic content of the vacuum gas oil feed 18. These hydrotreating reactions are generally characterized by a low amount of conversion, e.g. less than 20%, preferably less than 15%. In general, it is desirable to lower the nitrogen content of the hydrocarbon feedstock stream to less than 50 parts per million by weight (ppm), preferably less than about 10 ppm and for increased catalyst life to a level of less than 2 ppm or even as low as about 0.1 ppm. Similarly, it is generally desirable to lower the sulfur content of the hydrocarbon feedstock stream to less than about 0.5% by weight percent, preferably less than about 0.1%, and in many cases as low as about 1 ppm.

1ST STAGE CONDITIONS

Thus, the one or more reaction zones in first hydrocracker stage 22 are operated at reaction temperatures between 250° C. and about 500° C. (482–932° F.), pressures from 3.5 MPa to about 34.2 MPa (500–3500 psi), and a feed rate (vol. oil/vol. cat h) from 0.1 to about 20 $hr^{-1}$. Hydrogen circulation rates are in general in the range from about 350-std. liter $H_2$/kg oil to 1780 $H_2$/kg oil (2310–11750 standard cubic feet per barrel). Preferred reaction temperatures range from 340° C. to about 455° C. (644–851° F.). Preferred total reaction pressures range from 7.0 MPa to about 20.7 MPa (1000–3000 psi).

1ST STAGE CATALYST

Catalysts useful in first hydrocracker stage 22 generally contain at least one Group VIb metal (e.g. molybdenum) and at least one Group VIII metal (e.g. nickel or cobalt) on an alumina support. A phosphorous oxide component and a cracking component, such as silica-alumina and/or a zeolite, may also be present A layered catalyst system may also be used, e.g. the layered catalyst system taught in U.S. Pat. No. 4,990,243, which is incorporated herein by reference for all purposes. The catalyst selected for use in first hydrocracker stage 22 will generally have a pore volume in the range of 0.5 to 1.2 $cm^3$/g, with an average pore diameter of between 100 Å and 180 Å, and a surface area 120 and 400 $m^2$/g, wherein at least 60% of the pores have a pore diameter of more than 100 Å. The first stage catalyst could also be a layered system of hydrotreating and hydrocracking catalysts. The preferred catalyst for first hydrocracker stage 22 comprises a nickel molybdenum or cobalt molybdenum hydrogenation component and a silica-alumina component with an alumina binder.

HOT H2 STRIPPER

The effluent 48 from the first hydrocracking stage 22 contains unreacted hydrogen, gaseous and liquid products. Hydrogen isolated from effluent 48 contains $H_2S$ and $NH_3$. In conventional processes, such hydrogen is purified prior to use as recycle to the first hydrocracking stage or as $H_2$ feed to the second hydrocracking stage. The present process is based on the realization that hydrogen isolated from effluent 48 is suitable for use as $H_2$ feed to the crude desulfurization unit 04, without extensive purification. The use of hydrogen in this way is facilitated by passing effluent 48 to hot hydrogen stripper 24 for removing light gases contained therein, including hydrogen and light hydrocarbon gases, using heated hydrogen 36. Typically, hot hydrogen stripper 24 is operated at temperatures preferably between 260° C. and 399° C. (500° F. and 750° F.). Hydrogen-rich stream 44, which is isolated from hot hydrogen stripper 24, is combined with crude oil feed 02, preferably with no further purification, for desulfurizing crude oil feed 02 in crude desulfurization unit 04. Stripped effluent 50 isolated from hot hydrogen stripper 24 is passed to second hydrocracker stage 26 for further upgrading. In a preferred embodiment of the process, effluent 48 passes directly from reaction zone 22 to a single stage 24 for hot hydrogen stripping. Stripped effluent 48 is then passed directly as a heated liquid, with no cooling beyond the normal minimal cooling associated with movement through the pipes connecting the various processing units, to second hydrocracker stage 26 for further reaction.

2ND STAGE

Second hydrocracker stage 26 is a hydrocracking stage, operated at hydrocracking conditions and with a catalyst(s) suitable for molecular weight reduction, with additional sulfur, nitrogen and aromatics removal. Conditions in second hydrocracker stage 26 are suitable for per pass conversions of up to 90%. Indeed, operating second hydrocracker stage 26 in extinction recycle mode, with partially reacted product being recycled until all have been cracked, is also within the scope of the present process.

2ND STAGE CONDITIONS

The hydrocracking conditions used in the hydrocracker will range from 250° C. to about 500° C. (482–932° F.), pressures from about 3.5 MPa to about 24.2 MPa (500–3500 psi), and a feed rate (vol. Oil/vol. cat h) from 0.1 to about 20 $hr^{-1}$. Hydrogen circulation rates are generally in the range from about 350 std liters $H_2$/kg oil to 1780 std liters $H_2$/kg oil (2310–11750 standard cubic feet per barrel). Preferred total reaction pressures range from 7.0 MPa to about 20.7 MPa (1000–3000 psi). Second hydrocracker stage 26 is operated at temperatures of greater than 650° F. and pressures between about 1000 psig and 3500 psig, preferably between 1500 psig and 2500 psig hydrogen pressure.

2ND STAGE CATALYST

The catalyst used in the second hydrocracking stage 26 is a conventional hydrocracking catalyst of the type used to carry out hydroconversion reactions to produce transportation fuels. First hydrocracker stage 22 and second hydrocracker stage 26 can contain one or more catalyst in more than one reaction zone. If more than one distinct catalyst is present in either or the reaction zones, they may either be blended or be present as distinct layers. Layered catalyst systems are taught, for example, in U.S. Pat. No. 4,990,243. Hydrocracking catalyst useful for second hydrocracker stage 26 are well known. In general, the hydrocracking catalyst comprises a cracking component and a hydrogenation component on an oxide support material or binder. The cracking component may include an amorphous cracking component and/or a zeolite, such as a y-type zeolite, and ultrastable Y type zeolite, or a dealuminated zeolite. Particularly preferred catalytic cracking catalysts are those containing at least one zeolite which is normally mixed with a suitable matrix such as alumina, silica or silica-alumina. A suitable amorphous cracking component is silica-alumina. The preferred amorphous cracking component is between 10 and 90 weight percent silica, preferably between 15 and 65 weight percent silica, the remainder being alumina. A cracking component containing in the range from about 10% to about 80% by weight of the Y-type zeolite and from about 90% to about 20% by weight of the amorphous cracking component is preferred. Still more preferred is a cracking component containing in the range from about 15% by weight to about 50% by weight of the Y-type zeolite, the remainder being the amorphous cracking component. Also, so-called x-ray amorphous zeolites (i.e., zeolites having crystallite sizes too small to be detected by standard x-ray techniques) can be suitably applied as cracking components. Hydrogenation components suitable for the hydrocracking and/or hydrotreating catalysts which are used in the present integrated process include those which are comprised of at least one Group VIII (IUPAC Notation) metal, preferably iron, cobalt and nickel, more preferably cobalt and/or nickel and at least one Group VI (IUPAC Notation) metal, preferably molybdenum and tungsten, on a high surface area support material, preferably alumina. Other suitable catalysts include zeolitic catalysts, as well as noble metal catalysts where the noble metal is selected from palladium and platinum. It is within the scope of the present invention that more than one type of catalyst be used in the same reaction vessel. The Group VIII metal is typically present in an amount ranging from about 2 to about 20 weight percent. The Group VI metal will typically be present in an amount ranging from about 1 to about 25 weight percent. The hydrogenation components in the catalyst may be in the oxidic and/or the sulfidic form. If a combination of at least a Group VI and a Group VIII metal component is present as (mixed) oxides, it will be subjected a sulfiding treatment prior to proper use in hydrotreating or hydrocracking. Suitably, the catalyst comprises one or more components of nickel an/or cobalt and one or more components of molybdenum and/or tungsten or one or more components of platinum and/or palladium. Catalysts containing nickel and molybdenum, nickel and tungsten, platinum and/or palladium are particularly preferred.

The effective diameter of the zeolite catalyst particles are in the range of from about 1/32 inch to about 1/4 inch, preferably from about 1/20 inch to about 1/8 inch. The catalyst particles may have any shape known to be useful for catalytic materials, including spheres, cylinders, fluted cylinders, prills, granules and the like. For non-spherical shapes, the effective diameter can be taken as the diameter of a representative cross section of the catalyst particles. The catalyst particles will further have a surface area in the range of from about 50 to about 500 $m^2/g$.

LAYERED HYDROCRACKING ZONE FOR LIGHT GAS OIL HYDROTREATING

In FIG. 1, a light gas oil stream 20 isolated from the desulfurized liquid 10 is hydrotreated in 58 to remove sulfur and/or aromatics in preparation of a low sulfur, low aromatic fuel product 60. In a separate preferred embodiment illustrated in FIG. 2, the hydrotreating catalyst useful for hydrotreating light gas oil stream 20 is layered at or near the bottom of second hydrocracker stage 26. Thus, second hydrocracker stage 26 includes a layered catalyst system, with catalysts typically used for hydrocracking near the feed inlet to second hydrocracker stage 26 and one or more layers of catalyst typically used for hydrotreating near the product effluent outlet of second hydrocracker stage 26. The amount of hydrotreating catalyst in second hydrocracker stage 26 is generally smaller than the amount of hydrocracking catalyst included in second hydrocracker stage 26. In including the hydrotreating catalyst as a layer in an otherwise hydrocracking reaction mode, it is expected that the effluent from the catalyst layers for hydrocracking, having reacted at hydrocracking conditions in second hydrocracker stage 26, would not be modified to any significant extent in the layer of hydrotreating catalyst in second hydrocracker stage 26. However, the unreacted hydrogen in the reacting stream passing from the bed(s) of hydrocracking catalyst are available for further reaction without additional heating, pressurization and/or purification. Thus, light gas oil stream 20 stream, which is essentially fuel boiling range material, but with higher amounts of sulfur, nitrogen and/or aromatics than is permitted for current fuels, is passed to the portion of second hydrocracker stage 26 which contains the layer(s) of hydrotreating catalyst. Bypassing the hydrocracking catalyst beds reduces the amount of undesirable cracking of light gas oil 20 stream. Furthermore, reaction of light gas oil stream 20 in combination with the effluent from the layers of hydrocracking catalyst of second hydrocracker stage 26 serves to remove additional contaminants from light gas oil stream 20 without molecular weight reduction and without added hydrogen beyond that potentially required to quench exothermic heat release from the layers of hydrotreating catalyst in second hydrocracker stage 26. The reaction conditions for hydrotreating the naphtha stream in the second hydrocracker stage is expected to be the same as reaction conditions for hydrocracking in that stage. The blend of fuels produced in the various catalyst layers of second hydrocracker stage 26 is separated in product fractionator 30. At least one fuel stream, shown as 40 in FIG. 2, is isolated from product fractionator 30.

2ND STAGE PRODUCT

Effluent 52 from second hydrocracker stage 26 is separated in hydrocracker flash separation zone(s) 28 to isolate at least a recycle hydrogen stream 42 and a hydrocracked liquid product 62, which is passed to product fractionator 30 for fractionation. At least one low sulfur fuel product, 40, is isolated from product fractionator 30. However, it is expected that a full range of fuel products, including low sulfur naphtha, low sulfur kerosene and low sulfur diesel would desirably be isolated in the process. Stream 56 is combined with fresh hydrogen 32 and with isolated hydrogen stream 14 as hydrogen feed to first hydrocracker stage 22, to hot hydrogen stripper 24 to second hydrocracker stage 26. Incompletely reacted products from second hydrocracker stage 26 are recycled via 42 to second hydrocracker stage 26.

What is claimed is:

1. A crude oil desulfurization process comprising the following steps:

(a) hydrodesulfurizing a crude oil feed in a crude desulfurization unit to obtain a desulfurized crude oil;

(b) separating the desulfurized crude oil of step (a) into a light gas oil fraction, a vacuum gas oil fraction and a residual fraction;

(c) hydrocracking the vacuum gas oil fraction of step (b) into at least one fuel product having a low sulfur content; by means of the following steps:

(1) passing the vacuum gas oil in combination with hydrogen to a first hydrocracking reaction zone to create an effluent comprising at least one fuel product having a low sulfur content;

(2) passing at least a portion of the effluent of, step (1) to a second hydrocracking reaction zone; and (3) recycling at least a portion of the second hydrocracking reaction zone effluent to the second hydrocracking reaction zone, (d) hydrotreating the light gas oil fraction of step (b).

2. The process according to claim 1 wherein the second hydrocracking reaction zone comprises a multiplicity of layered catalyst beds, including at least one hydrotreating catalyst layer which is maintained at reaction conditions preselected for high hydrotreating activity.

3. The process according to claim 2 wherein the second hydrocracking reaction zone further comprises at least one hydrocracking catalyst layer which is maintained at hydrocracking reaction conditions, such that the entire effluent from the catalyst layer maintained at hydrocracking reaction conditions passes to the catalyst layer maintained at hydrotreating reaction conditions.

4. The process according to claim 3, which further comprises fractionating at least a portion of the effluent from the second hydrocracking reaction zone and isolating at least one fuel product and a recycle stream which is recycled to the second hydrocracking reaction zone.

5. The process according to claim 2 further comprising passing the light gas oil fraction to the hydrotreating catalyst layer.

6. The process according to claim 1, wherein (c) further comprises isolating at least a diesel having a low sulfur content, a kerosene having a low sulfur content, and a naphtha having a low sulfur content.

7. The process according to claim 1 wherein (c) further comprising:

passing the first hydrocracking zone effluent to a hot hydrogen stripper and isolating a first hydrogen-rich gaseous stream and effluent having a low-sulfur effluent and passing the hydrogen-rich gaseous stream to the crude desulfurization unit for hydrodesulfurizing the crude oil feed.

8. The process according to claim 2 further comprising passing the first hydrocracking zone effluent to a hot hydrogen stripper and isolating a hydrogen-rich gaseous stream and an effluent having a low sulfur content and passing the first hydrogen-rich gaseous stream to the crude desulfurization unit for hydrodesulfurizing the crude oil feed.

9. The process according to claim 8, which further comprises:

(a) passing the low-sulfur effluent, in combination with hydrogen to a second hydrocracking zone to produce a hydrocracked liquid product; and (b) fractionating the hydrocracked liquid product to form at least one fuel product having a low sulfur content.

10. The process according to claim 9, further comprising passing the low sulfur effluent to the hydrotreating catalyst layer.

11. The process according to claim 1 wherein step (b) further comprises:

separating the desulfurized crude oil in an atmospheric distillation column and isolating at least a light gas oil and an atmospheric residuum therefrom, (b) separating the atmospheric residuum of step (a) in a vacuum distillation column and isolating at least a vacuum residuum stream and a vacuum gas oil stream.

12. The process according to claim 7 wherein the first hydrocracking zone effluent is passed to a second hydrocracking reaction zone without substantially cooling the first hydrocracking zone effluent.

13. A crude oil desulfurization process comprising:

(a) hydrodesulfurizing a crude oil feed in a crude desulfurization unit to obtain a desulfurized crude oil;

(b) separating the desulfurized crude oil and isolating a light gas oil fraction, a vacuum gas oil fraction and a residual fraction;

(c) passing the vacuum gas oil in combination with hydrogen to a first hydrocracking reaction zone, where it is hydrocracked to produce a first hydrocracking zone effluent;

(d) passing at least a portion of the first hydrocracking zone effluent, to a second hydrocracking reaction zone comprising a multiplicity of catalyst beds, including at least one hydrotreating catalyst layer which contains catalyst preselected for high hydrotreating activity;

(e) passing the light gas oil fraction of step (d) to the hydrotreating catalyst layer of step (d) for hydrotreating the light gas oil fraction; and (f) recycling at least a portion of the combined effluent of steps (d) and (e) to the second hydrocracking reaction zone.

* * * * *